US006227406B1

(12) United States Patent
Herlacher

(10) Patent No.: US 6,227,406 B1
(45) Date of Patent: May 8, 2001

(54) LABEL DISPENSING DEVICE

(75) Inventor: Fredrick Herlacher, Topeka, KS (US)

(73) Assignee: Payless ShoeSource, Inc., Topeka, KS (US)

( * ) Notice: Subject to any disclaimer, the term of this patent is extended or adjusted under 35 U.S.C. 154(b) by 0 days.

(21) Appl. No.: 09/128,566

(22) Filed: Aug. 4, 1998

(51) Int. Cl.[7] ..... B65H 5/28

(52) U.S. Cl. ..... 221/185; 221/70; 221/72; 221/73; 224/162; 224/269

(58) Field of Search ..... 221/185, 70, 72, 221/73; 224/162, 269

(56) References Cited

U.S. PATENT DOCUMENTS

| | | | | |
|---|---|---|---|---|
| 2,276,296 | | 3/1942 | Flood | 206/38 |
| 2,341,368 | | 2/1944 | Flood | 206/58 |
| 3,146,149 | | 8/1964 | Silverstein | 156/385 |
| 3,369,952 | | 2/1968 | Reiger | 156/577 |
| 3,537,933 | | 11/1970 | Severance | 156/344 |
| 3,743,086 | | 7/1973 | Aldrich | 206/52 |
| 3,890,191 | | 6/1975 | Mayer | 156/541 |
| 4,570,868 | | 2/1986 | Wiggs et al. | 242/55.53 |
| 4,824,517 | | 4/1989 | Leahy | 156/584 |
| 4,954,210 | * | 9/1990 | Desmond | 221/71 X |
| 5,358,158 | * | 10/1994 | Darr | 224/162 |
| 5,378,301 | | 1/1995 | Boreali et al. | 156/344 |
| 5,497,904 | * | 3/1996 | Jones | 221/185 |
| 5,570,809 | * | 11/1996 | Martin | 221/73 |
| 5,938,070 | * | 8/1999 | Welborn et al. | 221/73 |

* cited by examiner

*Primary Examiner*—Christopher P. Ellis
*Assistant Examiner*—Patrick Mackey
(74) *Attorney, Agent, or Firm*—Lathrop & Gage L.C.

(57) ABSTRACT

A device for dispensing a label from a backing strip comprises a cartridge, a tab, and a detaching mechanism. The tab includes a first side, a second side and distal end. The detaching mechanism is configured to operatively cause the strip of backing material to be routed along each of the first and second sides of the tab and configured to detach the label from the strip of backing material as the corresponding strip of backing material traverses the distal end of said tab.

7 Claims, 1 Drawing Sheet

LABEL DISPENSING DEVICE

BACKGROUND OF THE INVENTION

1. Field of the Invention

The present invention relates to a label dispensing device and more particularly, to a device for dispensing individual labels from a roll of labels contained in a cartridge so that the labels may be removed manually from the label backing and applied to a product.

2. Description of the Related Art

The challenges facing all businesses today are numerous and complex. Even the challenge of determining inventory or the price to charge for a commodity within a package can at times be overwhelming for the small business. Bar coding and scanning have helped to alleviate some of these challenges and have proven very successful as is evident by the widespread use of scanning from grocery stores and department stores to book stores and auto parts stores. Nonetheless, there are still problems within the industry for those business entities that must apply the bar code label or other types of identifying labels to the final product that is to be placed into the stream of commerce. One of those problems is the ability to rapidly and reliably dispense, at minimal cost, labels from a dispenser containing a roll of labels so that they may be applied to products.

A label dispenser having a complex mechanical configuration is disclosed in U.S. Pat. No. 3,369,952 to Rieger. That system incorporates a drive mechanism utilizing an electric drive motor and a tape conveying system. The teachings of the '952 patent are incorporate herein by reference.

The low end of the market for label dispensing devices, however, has not developed to any great extent. Particularly, a need exists for dispensers that can rapidly and reliably dispense labels and not require a considerable financial investment for the purchase of the dispensing device. The simplicity of the present invention minimizes the potential for mechanical problems, provides for rapid dispensing and allows the dispensing device to be manufactured inexpensively. In addition, the carrying case provided with the dispensing device allows it to be secured to the wearer's clothing such that hands can be freed to perform other useful work without any loss of time. With the label dispenser safely and securely in place within the holder and the labels at the ready for dispensing, the present invention combines many desirable elements including; reliability, rapid operation and ease of use and safeguarding within the carrying case.

SUMMARY OF THE INVENTION

It is an object of the present invention to provide a rapid, reliable, readily securable and inexpensive means of dispensing labels.

Other objects and advantages of this invention will become apparent from the following description in conjunction with the accompanying drawings.

These objects are attained by the present invention, which provides a system for dispensing an individual label from a roll of labels. The system comprises a cartridge formed from a single strip of material for retaining the labels and the label backing material within a cavity formed within the cartridge. The cartridge is formed from a single strip of material configured such that a roughly rectangular cavity is formed with one end of the strip overlapping the other end creating a tab with an internal wall facing in the direction of the cavity and an external wall facing away from the cavity, and with a gap between the end of the strip and the tab sufficient for the labels and backing material to pass between the two with no interference. A cross member attached in a perpendicular fashion to the edges of two of the walls serves as a fifth wall of the cartridge and further bounds the volume of space which the roll of labels may occupy.

As the labels and backing material are pulled from the cartridge they are routed along the tab, under a restraining device configured to retain the backing material in place as it travels along the internal wall of the tab, over the end of the tab and along the external wall of the tab in the opposite direction from the backing material and labels traveling the internal wall. The end of the tab over which the backing material traverses is fairly smooth resulting in the development of minimal friction between the backing and the edge itself. The smoothness of the edge serves to avoid damage to, and tearing of, the backing as it passes over the edge and rapidly reverses direction.

In a more specific aspect of the invention, the restraining device may include a spring, wrapped around the tab, and secured in place by notches in the edges of the tab. Once the backing material and labels are secured in place by the restraining device they must follow a prescribed path. As the backing and labels are pulled from the cartridge and approach the end of the strip, the longitudinal stiffness of the labels begin to overcome the adhesive binding the labels to the backing resulting in delamination of the labels from the backing. Once delamination begins, the labels are readily removed, principally by manual means, from the backing for placement on a product.

According to the present invention, there is further provided a carrying case for the label dispensing device comprising a pouch attached to a backing that in turn can be attached to a wearer's clothing. The carrying case facilitates the transport and use of the label dispensing device. The cartridge fits within the pouch with the tab protruding in a substantially vertical direction and the label backing material trailing from under the restraining device on the external wall. The dispensing device is typically secured in place inside of the carrying case by a strap or similar mechanism.

BRIEF DESCRIPTION OF THE DRAWINGS

The accompanying drawings, which are incorporated in and constitute a part of the specification, illustrate one embodiment of the invention and together with the description, serve to explain the principles of this invention. In the drawings.

DETAILED DESCRIPTION OF THE INVENTION

Reference will now be made in detail to the preferred embodiment of the present invention, an example of which is illustrated in the accompanying figures. Whenever possible, the same reference numbers will be used throughout the description and figures to refer to the same or like parts.

A label dispensing device of the present invention is indicated generally at 10. The label dispensing device 10 includes a cartridge 12 for retaining a roll of labels, a rigid wall, and a detaching mechanism for detaching a label from the roll of labels.

Figure 2:
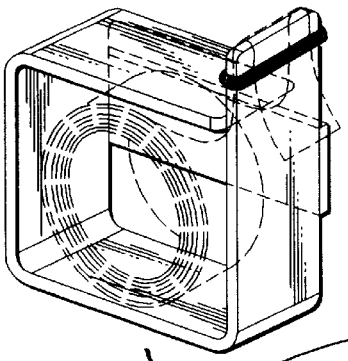
FIG. 2 is a perspective view of the cartridge of the present invention removed from the carrying case of the present invention.
Figure 2:
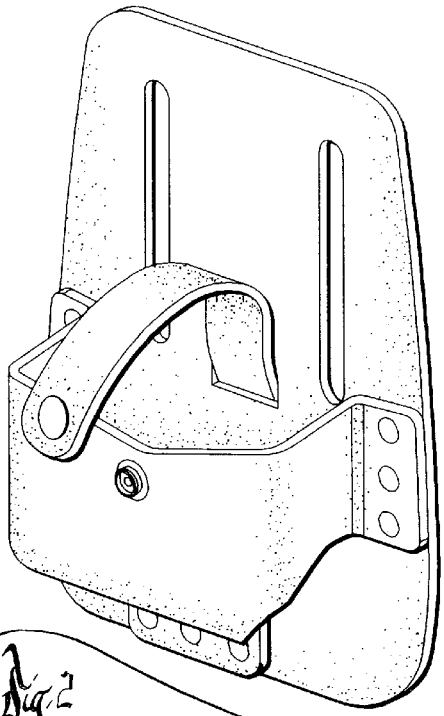

As shown in FIG. 2, the cartridge is generally rectangular shaped object having walls 51, 52, 53 and 54, which form a cavity 57 configured to contain the roll of labels 45. The cartridge includes a tab 41 on wall 54 as shown in FIG. 2, which extends beyond the intersecting wall 51. The roll of labels 45 are further secured within the cavity by a cross member 62, which extends from wall 54 to opposing wall 52 to prevent the roll from dropping from the cartridge.

Figure 3:
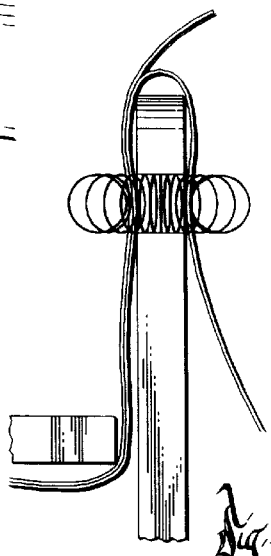
FIG. 3 is a partial side elevational view of the detaching mechanism of the present invention.

As shown in FIG. 3, a gap 63 is provided between the intersecting wall 51 and tab 41 through which the roll of labels, which includes at least one label 48 and the backing material 37, are fed. As the labels 48 and backing material 37 are extracted from the cavity 57 they pass through gap 63 and are routed along an inner wall 67 of the tab, under a restraining device 39, over a distal end of the tab 41, along a second side 71 of the tab and under the restraining device 39.

As shown in FIG. 3, once the label backing material 37 begins to reverse direction at the distal end of the strip—as the label backing material moves from the first side to the second side of the tab 41—the label 48 of the roll of labels positioned at this juncture delaminates from the backing material due to the longitudinal stiffness of the label overcoming the adhesive. As such, this partially delaminated label is easily removed manually from the backing material. The backing material 37 continues its path over the distal end of the strip 59, down the external wall of the tab 71 and under the restraining device 39 thereby forcing the label from the backing strip.

Figure 4:
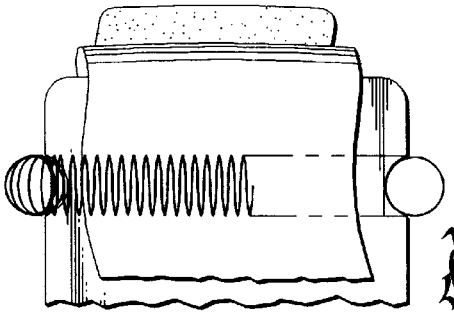
FIG. 4. is a partial side elevational view of the detaching mechanism of the present invention.

As shown in FIG. 4, the restraining device is preferably a spring that is held in place by notches 73, 74. The spring is circumjacent the sides of the tab 4 and, as mounted on the tab, is elastically deformed from its at rest position to securely remain on the tab 41 of the dispensing device 10. The notches 73, 74 are formed on the edges of the tab 41, slightly below the distal end of the strip 59.

Preferably, the label dispensing device includes a carrying case 15 for holding the cartridge 12. The carrying case 15 is comprised of three walls 23, 24 and 25, the backing panel 19 and a bottom wall 27. The walls 23, 24, 25 and 27 are attached to the backing panel by a series of rivets 29 or other similar attachment mechanisms. The label peeling device is attached to a wearer's belt 17 by routing the wearer's belt through slots 18 in the backing panel 19 of the carrying case. In order to secure the label peeling cartridge 12 within the carrying case 15, a strap 31 with a snap 33 is utilized for restraint. The strap extends from the backing panel 19, over the label peeling cartridge 12 and to the snap 33 which is located on the front wall 24 of the carrying case 15.

Figure 1:
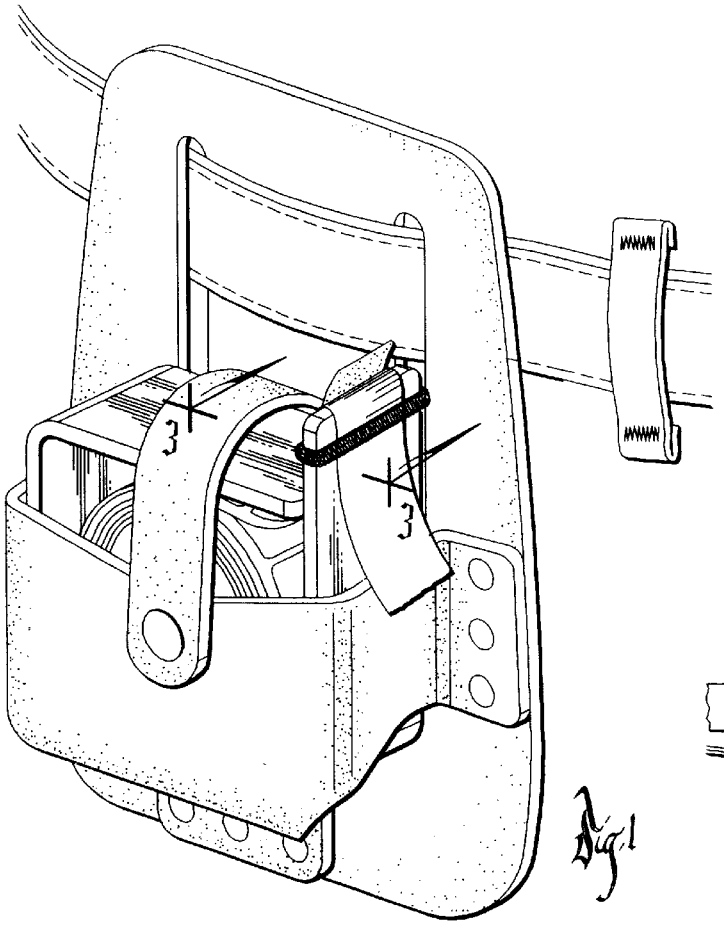
FIG. 1 is a perspective view of an embodiment of the present invention.

FIG. 1 represents the label peeling device configuration as it would likely be in actual operation, wherein the backing material 37 exits from under the restraining device 39 which surrounds a portion of the tab 41 that protrudes from the carrying case 15. In order to operate the label peeling device 10, manual force is applied to the label backing material 37 at, or near its free end 43. As the backing material 37 is pulled, the roll of labels 45 within the label peeling cartridge 12 unravels and feeds additional backing material 37 and labels 48 along the tab 41.

In use, an operator would insert a roll of labels 45 into the cavity 57 of the label peeling cartridge 12. The labels 48 and the backing material 37 would then be threaded through the gap 63 between the intersecting wall and tab 41, under the restraining device 39, over the distal end of the tab and once again under the restraining device 39 on the external wall 71 of the tab.

An application of force to the label backing material causes a label to be extracted from the cartridge 12 and, at the point where the backing material 37 reverses direction as it moves over the distal end of tab 41, the label delaminates from the backing material. The backing material 37 remains adjacent both the first and second sides of the tab 41 because the backing material is constrained against the sides of the tabs by the restraining device 39. As the backing material moves over the distal end of the strip 59, reversing direction in a short interval, the adhesive binding the labels 48 and backing material 37 together cannot overcome the inherent stiffness of the label thereby causing the label to delaminate from the backing. As a label 48 delaminates, it can readily be removed from the backing material for application to a product. Repeating the process enables additional labels to be withdrawn from the cartridge and removed from the backing material.

It is to be understood that while certain forms of the present invention have been illustrated and described herein, it is not to be limited to the specific forms or arrangement of parts described and shown.

The teaching of all references cited herein are incorporated by reference herein.

Detailed illustrative embodiments of the present invention are disclosed herein. However, the physical configuration of the present invention may be embodied in a wide variety of forms, some of which may be quite different from those of the disclosed embodiments. Consequently, the specific structural and functional details disclosed herein are merely representative; yet in that regard, they are deemed to afford the best embodiment for purposes of disclosure and to provide a basis for the claims herein which define the scope of the present invention.

What is claimed:

1. A device for dispensing a label detachably mounted to a strip of backing material, the device comprising:

a cartridge having a cavity containing a roll of backing material having at least one label mounted thereto;

a tab having a first side, a second side, and a distal end;

a spring mounted on the tab configured to operatively cause the strip of backing material to be routed along each of said first and second side of the tab and configured to detach the label from the strip of backing material as the corresponding strip of backing material traverses said distal end of said tab and wherein said spring is sized such that as mounted on the tab said spring is elastically deformed.

2. The device of claim 1, wherein said tab includes at least one notch and wherein the notch is configured to receive said spring whereby the elastically deformed spring is retained in the at least one notch.

3. The device of claim 1, including a pouch configured to operatively contain said cartridge.

4. The device of claim 1, wherein said tab is formed in a substantially rectangular configuration.

5. The device of claim 1, wherein said cartridge includes a cross member configured to provide a bottom for said cavity.

6. The device of claim 1, wherein said tab is constructed of plastic.

7. The device of claim 5, wherein an intersecting wall of said four walls terminates adjacent the tab such that a gap is formed therebetween, said gap being configured to receive a portion of the roll of labels therethrough as the label is being dispensed from the device.

* * * * *